US008567144B2

(12) United States Patent
Kelly

(10) Patent No.: US 8,567,144 B2
(45) Date of Patent: Oct. 29, 2013

(54) LOW COST ROOF SYSTEM AND METHOD OF CONSTRUCTING THE SAME

(76) Inventor: Thomas L. Kelly, Waterbury, CT (US)

( * ) Notice: Subject to any disclaimer, the term of this patent is extended or adjusted under 35 U.S.C. 154(b) by 1713 days.

(21) Appl. No.: 10/940,267

(22) Filed: Sep. 14, 2004

(65) Prior Publication Data

US 2006/0053718 A1 Mar. 16, 2006

(51) Int. Cl.
*E04B 5/00* (2006.01)

(52) U.S. Cl.
USPC ..... 52/409; 52/408; 52/746.1

(58) Field of Classification Search
USPC ..... 52/409, 408, 410, 411, 412, 746.1, 52/741.4
See application file for complete search history.

(56) References Cited

U.S. PATENT DOCUMENTS 4,063,395 A 12/1977 Stewart et al.
4,747,247 A * 5/1988 Petersen et al. ..... 52/408
5,950,383 A * 9/1999 Williamson et al. ..... 52/408
6,006,482 A * 12/1999 Kelly ..... 52/409
6,070,368 A * 6/2000 Anderson ..... 52/24
6,092,344 A * 7/2000 Kelly ..... 52/410
6,164,021 A * 12/2000 Huber et al. ..... 52/43
6,178,703 B1 * 1/2001 Noone et al. ..... 52/100
6,751,923 B1 * 6/2004 Nunley ..... 52/783.19
2005/0288394 A1 * 12/2005 Rothman et al. ..... 523/219

OTHER PUBLICATIONS

CA OA Application No. 2,518,286 dated Dec. 27, 2012.

* cited by examiner

*Primary Examiner* — Branon Painter
(74) *Attorney, Agent, or Firm* — Cantor Colburn LLP

(57) ABSTRACT

Disclosed herein is low cost roofing system. The system includes a roof deck, a sealant material disposed only at all locations on the roof deck that would otherwise be gas and liquid transmissive, insulation upwardly adjacent the roof deck, weight board upwardly adjacent the insulation, and a waterproofing membrane upwardly adjacent the weight board.

Further disclosed herein is method for constructing the low cost rapidly installed roof system. The method includes sealing all openings in a roof deck, which without said sealing would allow migration of fluid therethrough, disposing insulation upwardly adjacent the roof deck, disposing weight board upwardly adjacent the insulation, applying sealing compound at a roof edge or penetration extending from the roof deck to a top surface of the weight board, and installing a waterproofing membrane upwardly adjacent the weight board.

6 Claims, 2 Drawing Sheets

LOW COST ROOF SYSTEM AND METHOD OF CONSTRUCTING THE SAME

BACKGROUND

Traditionally, commercial roofing systems have been expensive for four reasons: high material cost, high labor cost, high workman compensation cost and high equipment cost. Heretofore, relatively little could be done to reduce these costs. Each of the components of such roof system may comprise different materials such as base materials, insulating materials, covering materials, waterproofing materials and weighting materials require installation, generally as a substantial time investment. The last high cost factor in the roof system is the equipment necessary to install traditional roof systems. Contractors must invest substantial sums of money in large and heavy equipment which then requires further investment in devices capable of rendering such equipment moveable. The cost is effectively spread over the customers jobs increasing the costs thereof.

SUMMARY

Disclosed herein is low cost roofing system. The system includes a roof deck, a sealant material disposed only at all locations on the roof deck that would otherwise be fluid transmissive, insulation upwardly adjacent the roof deck, weight board upwardly adjacent the insulation, and a waterproofing membrane upwardly adjacent the weight board.

Further disclosed herein is method for constructing the low cost rapidly installed roof system. The method includes sealing all openings in a roof deck, which without said sealing would allow migration of fluid therethrough, disposing insulation upwardly adjacent the roof deck, disposing weight board upwardly adjacent the insulation, applying sealing compound at a roof edge or penetration extending from the roof deck to a top surface of the weight board, and installing a waterproofing membrane upwardly adjacent the weight board.

BRIEF DESCRIPTION OF THE DRAWINGS

Referring now to the drawings wherein like elements are numbered alike in the several Figures.

DETAILED DESCRIPTION

A more inexpensive means to build roof systems (i.e. one that does not require expensive equipment) would be very beneficial to the roofing art since smaller contractors would have sufficient funds to enter the marketplace thereby increasing competition and ensuring competitive pricing. The method and system disclosed herein provides for a solid, reliable roof system that can be rapidly installed with minimal equipment yet passes Underwriters Laboratory and code body requirements for wind uplift, fire retardancy, etc.

Figure 1:
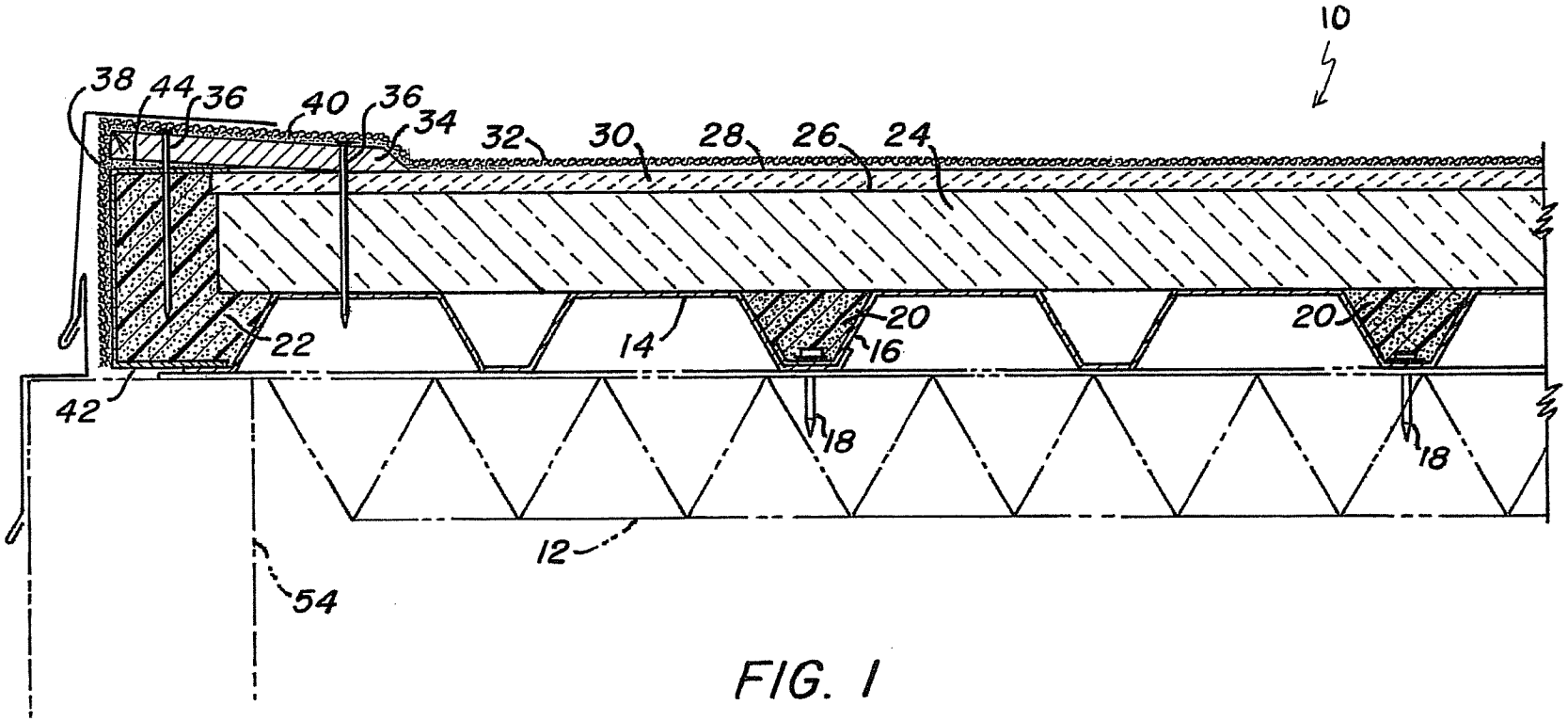
FIG. 1 is a schematic cross-sectional view of a portion of the roof system which constitutes an embodiment of the invention using a "C" channel for a perimeter nailer.

Referring to FIG. 1, one embodiment of the roof system 10 as taught herein is illustrated. One of ordinary skill in the art should recognize a truss 12. It needs to be understood that truss 12 is suitably supported subjacently by building structure that is not relevant to the roof system disclosed herein and therefore need not be described or illustrated. Supported by the truss 12 is a deck 14 which in this illustrated embodiment is a corrugated metal deck. It will be understood that the concept set forth herein is applicable to wooden, wood, composite plank, precast and poured in place decks as well. The roof deck 14, constructed of metal corrugated decking has multiple corrugated panels which are subjacent supported by the truss 12, and are overlapped at overlap flutes 16. Such decking is laid all over the roof structure of the building. The decking is also mechanically fastened to the underlying truss 12 by fastener 18 which as will be understood by one of ordinary skill in the art causes a hole to exist in metal decking 14. It is further pointed out that at overlapping flutes 16 there is no inherent seal between the metal decking panels, the flute constituting an elongated hole in the metal decking. The holes by fasteners 18 and the elongated hole overlap flute 16 may not be allowed to exist in a roof system as taught herein. Therefore, it is taught herein that an application of a sealant material 20 such as a polyurethane foam or polyurea is applied to overlapping flute section 16 and in any places where fasteners 18 have penetrated the deck 14. For wood and other panel decks, all joints would be sealed as well as any through roof penetrations. In addition, a sealing material 22 which may also be a polyurethane foam, polyurea, or other sealing compound is applied at an edge region 42 of the roof or at any through roof deck penetration area of the roof filling a gap between that edge or penetration and insulation material 24. In one embodiment, and as illustrated, foam 22 extends from the roof deck in an upwardly direction beyond an upper surface 26 of insulation 24 and all the way to an upper surface 28 of a cover board 30. The cover board 30 is intended to weight the insulation 24 in place so that it does not move upwardly in wind conditions and to provide a surface on which building personnel may work. The insulation material may be polyisocyanurate or expanded or extruded polystyrene as well as other insulating materials common to the roofing industry. The cover board 30 comprises one or more of gypsum, oriented strand board, plywood, rigid fiber board or other relatively heavy solid board material. In order to waterproof the roof structure a membrane 32, which in one embodiment is an EPDM membrane, is installed upwardly adjacent the cover board 30. This membrane 32 may be loose laid or fully adhered to the cover board 30 as is known in the art. It may further be desirable at a roof edge of this system to provide a nailer 34 and extended fastener 36 toward the edge 38 of the roof structure. The membrane 32 would then, of course, be laid above the fastener 36 and generally would be adhered in that location by adherent 40. In this particular embodiment, membrane 32 is wrapped over the edge of the roof structure and adhered to a C-channel 42 attached to the roof structure. C-channel 42 may be adhesively attached to the nailer 34 by adhesive 44 which may be a mastic type compound or other suitable roofing adherent material.

One of skill in the roofing art will recognize that nowhere in this application has applicant described the use of adhesive materials between the roof deck 14 and the insulation 24 or between the insulation 24 and the cover board 30. Although it might be expected by one of ordinary skill in the art that such would be necessary, in the present method such is not necessary therefore the cost in materials and labor to install such materials can be avoided in this roof system. Due to significantly less volume of foam utilized, small handheld foamers are employed. These have significantly reduced equipment cost thereby facilitating one of the benefits noted above.

Since the deck 14 is sealed to the passage of any fluids, significantly less wind uplift is experienced by the interior of the roof system. Therefore, it is not necessary to add the additional adhesive material.

Figure 2:
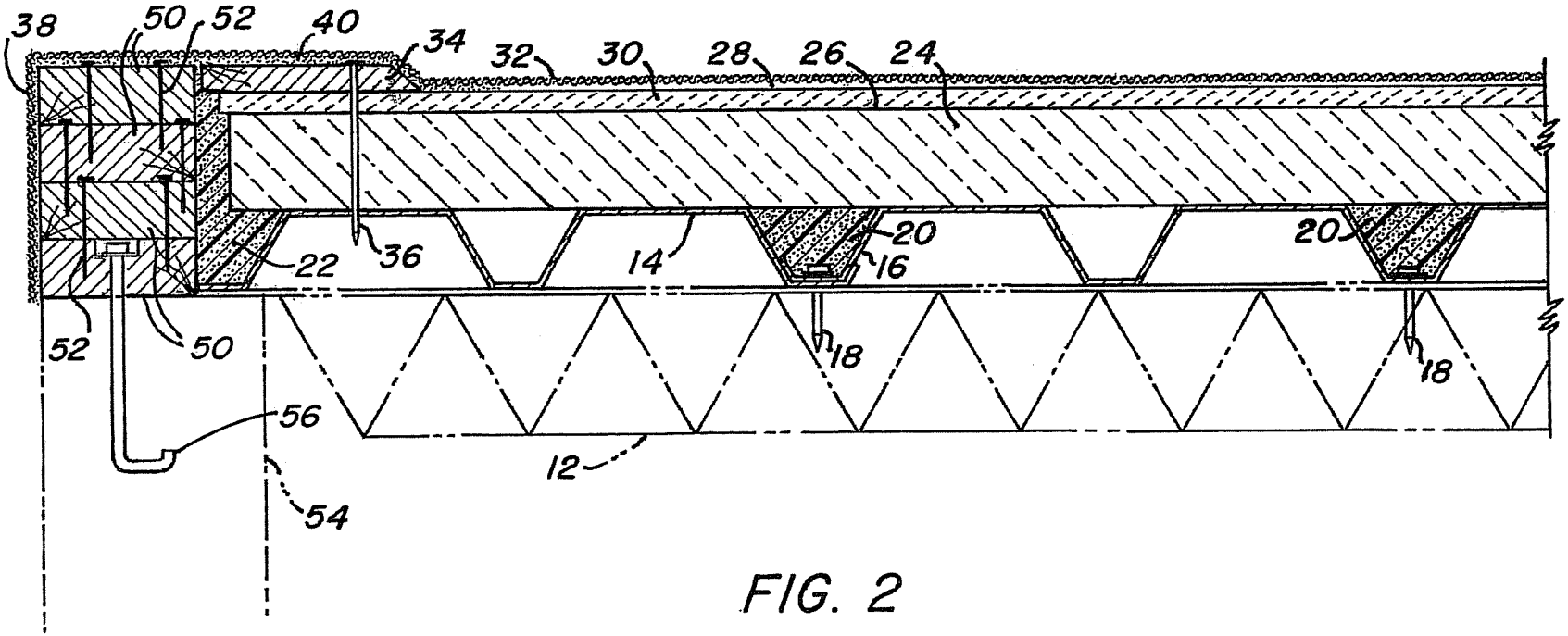
FIG. 2 is a schematic cross-sectional view of the edge portion of the roof system using traditional wood nailers.

Referring to FIG. 2, a similar structure is illustrated but is constructed utilizing edge nailers 50. These are characteristically nailed together with fasteners 52 and secured to a solid building structure such as wall 54 with a J-bolt 56. In other respects the foregoing description applied to this embodiment.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed:

1. A low cost roof system comprising:

a roof deck including overlapping flutes;

a sealant material disposed only at locations on the roof deck that would otherwise be fluid transmissive, said locations consisting of:

areas created by penetration of a fastener through said roof deck and into a structural carrying member of the roof deck, said sealant material surrounding an upper extent of said fastener in a manner that substantially fills said overlapping flutes of said roof deck, and areas created by at least one of an opening defined by an upper extent of a C-channel, a closed end of said C-channel, a lower extent of said C-channel, and portions of a weight board, insulation material, and the roof deck disposed in proximity to an open end of said C-channel, and an opening defined by at least one edge nailer and portions of said weight board, said insulation material, the roof deck and an additional nailer disposed in proximity to said edge nailer, said additional nailer being disposed upwardly adjacent of said weight board;

wherein said opening defined by said C-channel and said opening defined by said edge nailer are both substantially enclosed, filled with said sealant material such that each defining element of each of said openings is in contact with said sealant material, and disposed adjacent to an edge of the roof;

wherein said insulation is upwardly adjacent the roof deck, wherein at least a portion of said insulation is disposed upwardly adjacent of said sealant material, wherein at least a portion of said sealant material is disposed upwardly of and in contact with said upper extent of said fastener, and wherein at least a portion of said insulation is disposed upwardly of said upper extent of said fastener;

wherein said weight board is disposed upwardly adjacent the insulation; and a waterproofing membrane upwardly adjacent the weight board.

2. A low cost roof system as claimed in claim 1 wherein the sealant material is polyurethane foam.

3. A low cost roof system as claimed in claim 1 wherein the sealant material is polyurea.

4. A low cost roof system as claimed in claim 1 wherein the deck is a metal deck.

5. A low cost roof system as claimed in claim 1 wherein the membrane is adhered to the weight board.

6. A method for constructing the low cost rapidly installed roof system that includes a roof deck and overlapping flutes, the roof system comprising comprising:

sealing locations on the roof deck that would otherwise be fluid transmissive via a sealant material, said locations consisting of:

areas created by penetration of a fastener through said roof deck and into a structural carrying member of the roof deck, said sealant material surrounding an upper extent of said fastener in a manner that substantially fills said overlapping flutes of said roof deck, areas created by at least one of an opening defined by an upper extent of a C-channel, a closed end of said C-channel, a lower extent of said C-channel, and portions of a weight board, insulation material, and the roof deck disposed in proximity to an open end of said C-channel, and an opening defined by at least one edge nailer and portions of said weight board, said insulation material, the roof deck and an additional nailer disposed in proximity to said edge nailer, said additional nailer being disposed upwardly adjacent of said cover board;

wherein said opening defined by said C-channel and said opening defined by said edge nailer are both substantially enclosed, filled with said sealant material such that each defining element of each of said openings is in contact with said sealant material, and disposed adjacent to an edge of the roof;

disposing said insulation upwardly adjacent the roof deck;

disposing at least a portion of said insulation upwardly adjacent of said sealant material, wherein at least a portion of said sealant material is disposed upwardly of and in contact with an upper extent of said fastener, and wherein at least a portion of said insulation is disposed upwardly of said upper extent of said fastener;

disposing said weight board upwardly adjacent the insulation;

and installing a waterproofing membrane upwardly adjacent the weight board.

* * * * *